US010713989B2

(12) United States Patent
Chen et al.

(10) Patent No.: US 10,713,989 B2
(45) Date of Patent: Jul. 14, 2020

(54) DISPLAY PANEL, DRIVING METHOD OF THE SAME AND DISPLAY DEVICE

(71) Applicant: WuHan TianMa Micro-Electronics Co., Ltd., Wuhan (CN)

(72) Inventors: Zhonghuai Chen, Wuhan (CN); Min Huang, Wuhan (CN); Ying Sun, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 91 days.

(21) Appl. No.: 16/177,531

(22) Filed: Nov. 1, 2018

(65) Prior Publication Data

US 2019/0139477 A1 May 9, 2019

(30) Foreign Application Priority Data

Nov. 3, 2017 (CN) ..... 2017 1 1068790

(51) Int. Cl.
*G09G 3/36* (2006.01)
*G09G 3/20* (2006.01)
*G09G 3/3275* (2016.01)

(52) U.S. Cl.
CPC ..... *G09G 3/20* (2013.01); *G09G 3/3275* (2013.01); *G09G 3/3685* (2013.01); *G09G 2300/0408* (2013.01); *G09G 2300/0426* (2013.01); *G09G 2310/0275* (2013.01); *G09G 2310/0286* (2013.01); *G09G 2310/0297* (2013.01); *G09G 2310/08* (2013.01); *G09G 2320/0233* (2013.01); *G09G 2320/0242* (2013.01); *G09G 2330/021* (2013.01)

(58) Field of Classification Search
None
See application file for complete search history.

(56) References Cited

U.S. PATENT DOCUMENTS

2001/0003418 A1* 6/2001 Fujita ..... G09G 3/3674 324/76.54
2002/0015031 A1* 2/2002 Fujita ..... G09G 3/3659 345/204

(Continued)

FOREIGN PATENT DOCUMENTS

CN 2809779 Y 4/2014
CN 105895025 A 8/2016

*Primary Examiner* — Parul H Gupta
(74) *Attorney, Agent, or Firm* — Tarolli, Sundheim, Covell & Tummino LLP

(57) ABSTRACT

The present disclosure provides a display panel, a driving method and a display device. The display panel includes first data lines and first gate lines in an auxiliary display area, a first scanning unit, M second scanning units, M switch unit groups corresponding to the M second scanning units, M second data lines corresponding to the M switch unit groups, where M is an integer greater than 1. Each second scanning unit has output terminals and a control terminal connected to a main driving chip. Each switch unit group includes a plurality of switch units having a plurality of control terminals connected to the output terminals of the second scanning unit, a plurality of first terminals respectively connected to the first data lines, and second terminals. Each second data lines is connected to the main driving chip and the second terminals of the switch units.

12 Claims, 9 Drawing Sheets

(56) References Cited

U.S. PATENT DOCUMENTS

| | | | | |
|---|---|---|---|---|
| 2002/0080106 | A1* | 6/2002 | Miwa | G09G 3/3685 345/87 |
| 2004/0051836 | A1* | 3/2004 | Jung | G02F 1/1345 349/149 |
| 2005/0259095 | A1* | 11/2005 | Kwak | G09G 3/3233 345/204 |

* cited by examiner

DISPLAY PANEL, DRIVING METHOD OF THE SAME AND DISPLAY DEVICE

CROSS-REFERENCE TO RELATED APPLICATIONS

The present application claims priority to Chinese Patent Application No. 201711068790.7, filed on Nov. 3, 2017, the content of which is incorporated herein by reference in its entirety.

TECHNICAL FIELD

The present disclosure relates to display technology, and more particularly, to a display panel, a driving method thereof, and a display device.

BACKGROUND

With a rapid development of display technology, a display panel having a non-rectangular display area has been more and more widely used. Compared with the conventional display panel, the non-rectangular display area of such display panel includes a main display area and an auxiliary display area. As shown in FIG. 1, gate lines Gate extend along a row direction and data lines Data extend along a column direction. Since the display panel has the non-rectangular display area, the display panel has two types of the data lines Data having different lengths L1 and L2, which in turn causes the boundary between an area of the data line of a length L1 and an area of the data line of a length L2 to be visible.

In order to overcome the above problem, the data lines are arranged in the main display area and the auxiliary display areas separately in the related art. However, when adopting such arrangement, it is needed to additionally provide a sub driving chip for driving the data lines arranged in the auxiliary display area, which can increase the structural complexity and thus result in an increase in manufacturing cost.

SUMMARY

The present disclosure provides a display panel, a driving method thereof, and a display device, aiming to solve the problem of the boundary being visible in the display panel when using only one main driving chip.

In a first aspect, the present disclosure provides a display panel, having a main display area and an auxiliary display area protruding from the main display area. The display panel includes: a plurality of first data lines and a plurality of first gate lines arranged in the auxiliary display area, wherein the plurality of first data lines intersects with the plurality of first gate lines, and the plurality of first data lines and the plurality of first gate lines are insulated from one another; a first scanning unit connected to a main driving chip and the plurality of first gate lines; M second scanning units, each of the M second scanning units having a plurality of output terminals and a control terminal connected to the main driving chip, wherein M is an integer greater than 1; M switch unit groups corresponding to the M second scanning units in one-to-one correspondence, each of the M switch unit groups including a plurality of switch units, wherein the plurality of switch units in each of the M switch unit groups has a plurality of control terminals respectively connected to the plurality of output terminals of a corresponding second scanning unit in one-to-one correspondence, a plurality of first terminals respectively connected to the plurality of first data lines in one-to-one correspondence, and a plurality of second terminals; and M second data lines corresponding to the M switch unit groups in one-to-one correspondence. Each of the M second data lines is connected to the main driving chip and the plurality of second terminals of the plurality of switch units in each of the M switch unit groups.

In a second aspect, the present disclosure provides a driving method of a display panel, applicable to the display panel according to the first aspect.

In a third aspect, the present disclosure provides a display device, comprising the display panel according to the first aspect.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings without any creative effort.

DESCRIPTION OF EMBODIMENTS

In order to better understand technical solutions of the present disclosure, the embodiments of the present disclosure are described in details with reference to the drawings.

It should be clear that the described embodiments are merely part of the embodiments of the present disclosure rather than all of the embodiments. All other embodiments obtained by those skilled in the art without paying creative labor shall fall into the protection scope of the present disclosure.

The terms used in the embodiments of the present disclosure are merely for the purpose of describing specific embodiments, rather than limiting the present disclosure. The singular form “a”, “an”, “the” and “said” used in the embodiments and claims shall be interpreted as also including the plural form, unless indicated otherwise in the context.

It should be understood that, the term "and/or" is used in the present disclosure merely to describe relations between associated objects, and thus includes three types of relations. That is, A and/or B can represent: (a) A exists alone; (b) A and B exist at the same time; or (c) B exists alone. In addition, the character "/" generally indicates "or".

It should be understood that, although expressions "first", "second", "third" etc. are used to describe specific data lines or gate lines, they shall not be interpreted as limiting the specific data lines or gate lines. These expressions are merely used to distinguish among the specific data lines or among the specific gate lines. For example, without departing from the scope of the present disclosure, a first data line can also be referred as a second data line, and vice versa.

Figure 1:
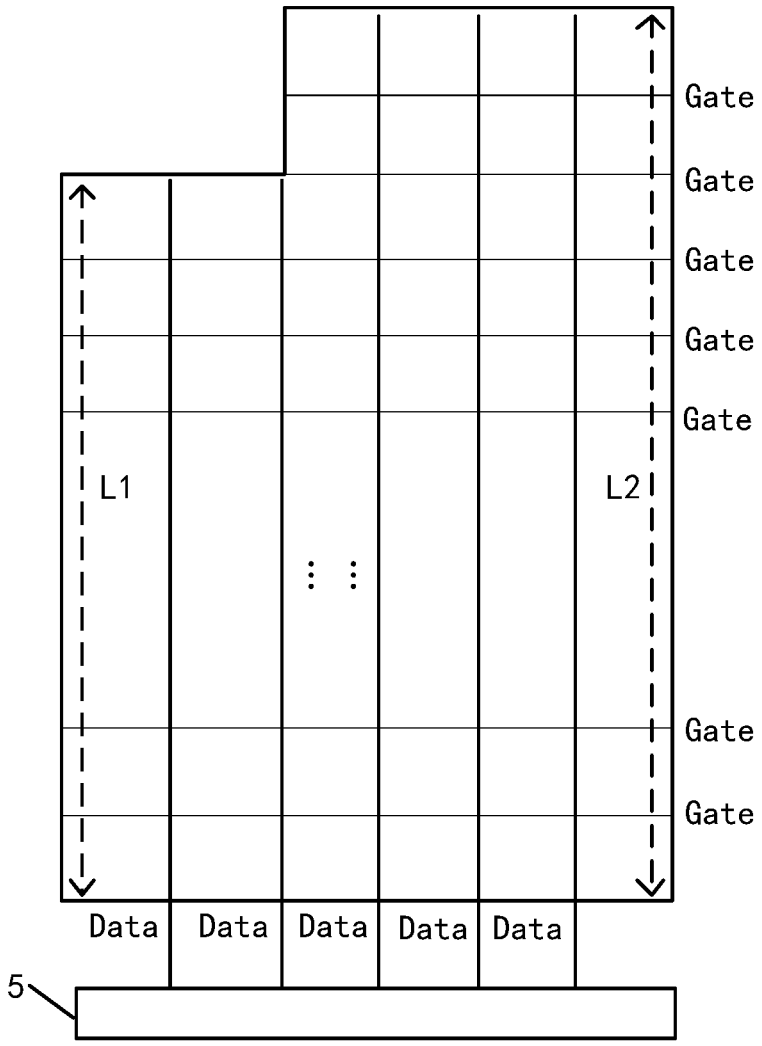
FIG. 1 (PRIOR ART)
FIG. 1 is a structural schematic diagram of a display panel having an irregular display area provided in the related art.

Still referring again to FIG. 1, the conventional display panel having a non-rectangular display area includes data lines Data and gate lines Gate that intersect with one another and are insulated from one another, and a main driving chip 5 for driving the data lines Data. In such display panel, there are two kinds of data lines Data having different lengths, and the data lines of different lengths have different data line impedances, which results in a brightness difference between an area of the data line Data of a length L1 and an area of the data line Data of a length L2 when the panel is displaying an image. Therefore, this can further lead to an obvious boundary between those two areas, i.e., the problem of visible boundary.

In order to overcome the problems of the visible boundary mentioned above, the data lines and the gate lines are usually provided in the main display area and the auxiliary display area separately in the related art. That is, the main display area and the auxiliary display area are driven separately. The main display area refers to an area for conventionally presenting information in the display area, and the auxiliary display area refers to a non-rectangular area in the display area, which is usually used to display notifications or quick-menus. Generally, in at least one direction, a length of the auxiliary display area is smaller than a length of the main display area.

Figure 2:
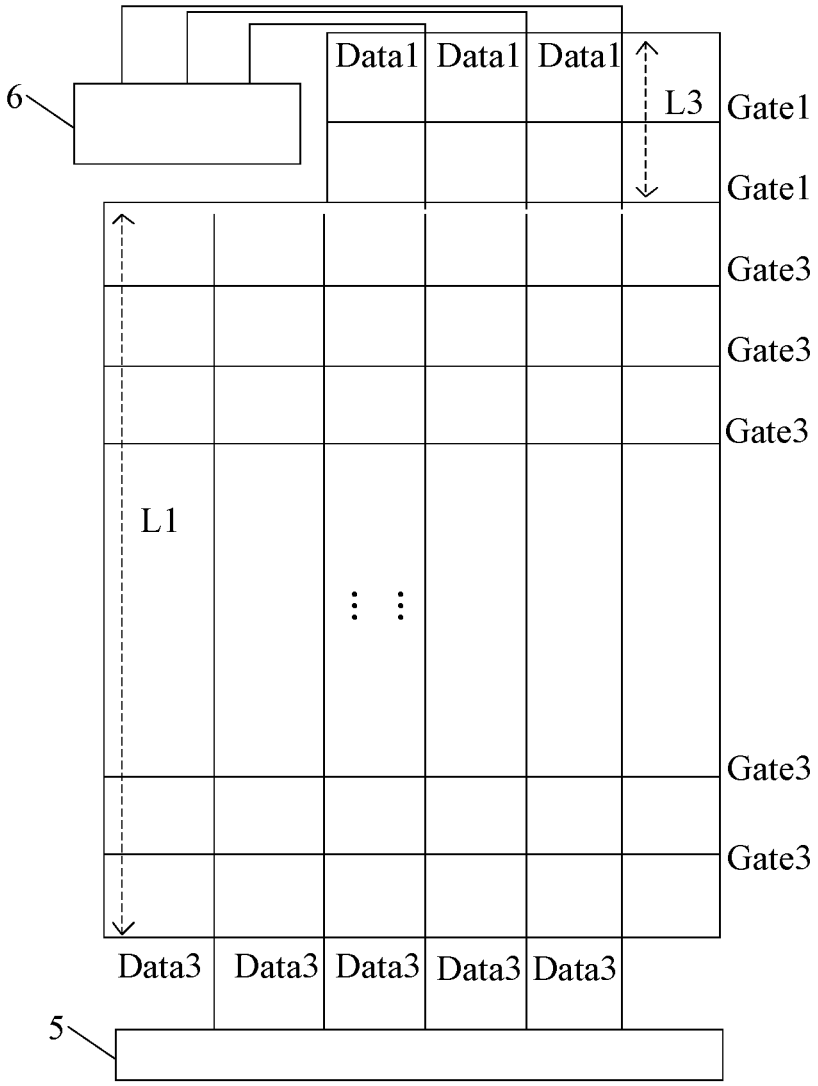
FIG. 2 (PRIOR ART)
FIG. 2 is another structural schematic diagram of a display panel having an irregular display area provided in the related art.

As shown in FIG. 2, the auxiliary display area includes a first data line Data1 and a first gate line Gate1 that intersect with one another and are insulated from one another, and the main display area includes a third data line Data3 and a third gate line Gate3 that intersect with one another and are insulated from one another. The first data line Data1 has a length of L3, and the third data line Data3 has a length of L1. However, in such arrangement, if the main driving chip 5 is required to drive the first data line Data1 in the auxiliary display area, each first data line Data1 has to be connected to the main driving chip 5 through a second data line, which is used to achieve signal transmission. In this way, there are a large number of second data lines Data2 extending over the main display area. In order to avoid such complicated wiring, a sub-driving chip 6 should be arranged next to the auxiliary display area for separately driving the first data line Data1 in the auxiliary display area. Although the sub-driving chip 6 additionally arranged in the display panel simplifies the wiring of the main display area, the structural complexity of the display panel may be increased, which in turn causes an increase of the manufacturing cost.

Figure 3:
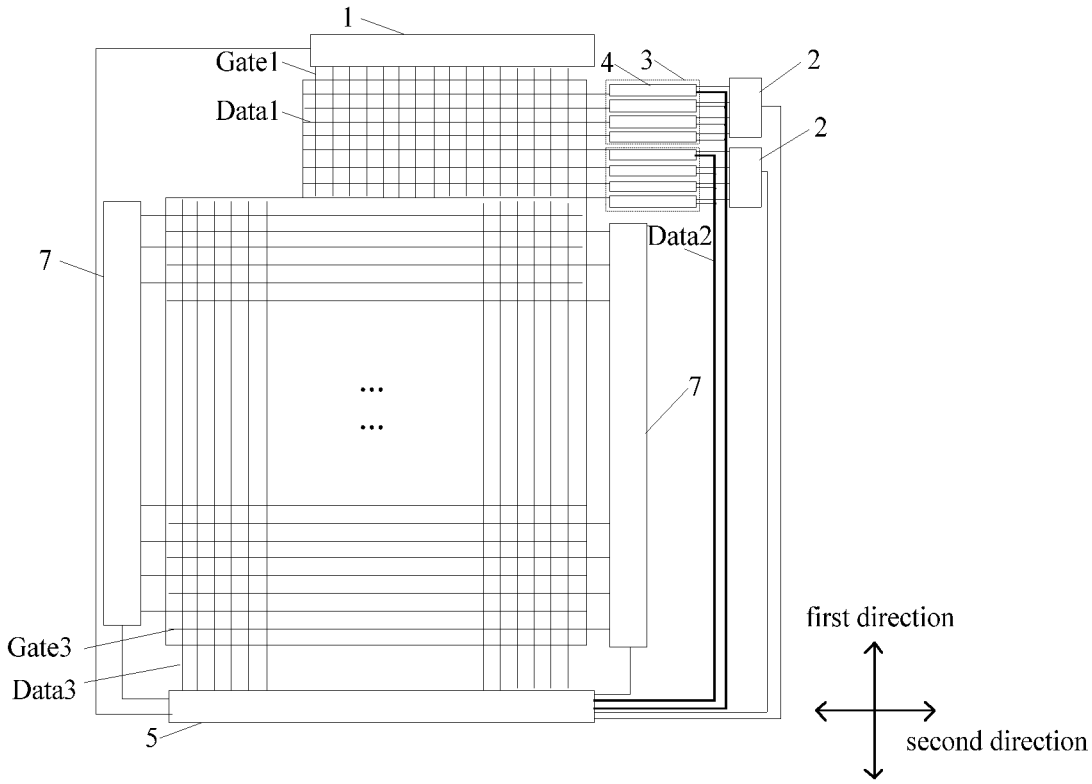
FIG. 3 is a structural schematic diagram of a display panel according to an embodiment of the present disclosure.

With respect to the above problem, an embodiment of the present disclosure provides a display panel, as shown in FIG. 3. A display area of the display panel includes a main display area and an auxiliary display area protruding from the main display area. The display panel includes a plurality of first data lines Data1, a plurality of first gate lines Gate1, a first scanning unit 1, M second scanning units 2, M switch unit groups 3 corresponding to the M second scanning units 2 in one-to-one correspondence, and M second data lines Data2 corresponding to the M switch unit groups 3 in one-to-one correspondence. The plurality of first data lines Data1 and the plurality of first gate lines Gate1 intersect with one another and are insulated from one another, and are arranged in the auxiliary display area. Each switch unit group 3 includes a plurality of switch units 4.

It should be understood that, the M second scanning units 2 shown in FIG. 3, where M=2, are merely illustrative, instead of a specific limitation on the number of the second scanning units 2. In a practical application, M can be any positive integer greater than 1.

The first scanning unit 1 has a control terminal connected to the main driving chip 5, and a plurality of output terminals respectively connected to the plurality of first gate lines Gate1 in one-to-one correspondence.

Each second scanning unit 2 has a control terminal connected to the main driving chip 5, and a plurality of output terminals. The plurality of switch units 4 in each switch unit group 3 has a plurality of control terminals respectively connected to the plurality of output terminals of a corresponding second scanning unit 2 in one-to-one correspondence, a plurality of first terminals respectively connected to the plurality of first data lines Data1 in one-to-one correspondence and a plurality of second terminals. Each second data lines Data2 is connected to the main driving chip 5 and the plurality of second terminals of the plurality of switch units 4 in a corresponding switch unit group 3.

When the auxiliary display area of the above-mentioned display panel is driven to perform display, the main driving chip 5 drives the first scanning unit 1 to operate, so that the first scanning unit 1 sequentially provides a first scanning signal to the first gate lines Gate1. When the first scanning signal is received by each first gate line Gate1, the main driving chip 5 drives the M second scanning units 2 to operate simultaneously, and each second scanning unit 2 controls the corresponding switch units 4 to be turned on in a time division manner, so that the first data signal transmitted via the second data lines Data2 is transmitted to the corresponding first data lines Data1 in a time division manner.

It can be understood that the first data signal refers to a signal provided by the main driving chip 5 and used for driving the auxiliary display area to display an image. According to an actual requirement on the image to be displayed by the auxiliary display area, different or same first data signals are transmitted to different first data lines Data1 via the second data lines Data2.

On the one hand, in the display panel provided by the present embodiment, by arranging data lines in the main display area and the auxiliary display area separately, the data lines in the main display area can have a same length, so that the data lines in the main display area have a same data line impedance. In this way, the brightness difference between different areas, which is caused by different data line impedances, can be avoided, and thus the problem of visible boundary between different areas can be solved. On the other hand, compared with the display panel shown in FIG. 2, in the display panel provided by the present embodiment, on basis of a mutual cooperation of the second scanning units 2, the switch units 4, the first data lines Data1 and the second data lines Data2, all the first data lines Data1 can be driven by the second data lines Data2 having a number equal to a number of the second scanning units 2, without providing each first data lines Data1 with one second data line Data2. In this way, the number of the second data lines Data2 is reduced significantly. In addition, when the number of the second data lines Data2 is relatively small, the second data lines Data2 can be directly connected to the main driving chip 5, and thus an additional sub-driving chip is no more required, thereby lowering the structural complexity and further reducing the manufacturing cost.

Specifically, when a second scanning unit 2 includes N output terminals, the second scanning unit 2 can drive N first data lines Data1; and when the display panel includes M second scanning units 2, all of the second scanning units 2 can drive M*N first data lines Data1. That is, by adopting the display panel provided by the present embodiment, the M*N first data lines Data1 can be driven by only using M second scanning units 2. Accordingly, M second data lines Data2 are provided. Compared with the M*N second data lines Data2 corresponding to the M*N first data lines Data1 needed in the related art, M*(N−1) second data lines Data2 can be saved in the present embodiment, which can not only simplify the wiring arrangement but also reduce the space occupied by the second data lines Data2.

In addition, still referring to FIG. 3, a plurality of third data lines Data3 and a plurality of third gate lines Gate3 that intersect with one another and are insulated from one another are arranged in the main display area of the display panel. The plurality of third data lines Data3 is connected to the main driving chip 5, respectively. Correspondingly, the display panel further includes a third scanning unit 7. The third scanning unit 7 has a control terminal connected to the main driving chip 5, and a plurality of output terminals respectively connected to the plurality of third gate lines Gate3.

When the main display area of the display panel is driven to display an image, the main driving chip 5 drives the third scanning unit 7 to operate, so that the third scanning unit 7 sequentially provides a second scanning signal to the third gate lines Gate3. When each third gate line Gate3 receives the second scanning signal, the main driving chip 5 provides the second data signal to the plurality of third data lines Data3.

It should be understood that the second data signal refers to a signal provided by the main driving chip 5 for driving the main display area to display an image. According to an actual requirement on the image to be displayed by the main display area, the main driving chip 5 provides the second data signal to the plurality of third data lines Data3.

Still referring to FIG. 3, there are preferably two third scanning units 7. When the third gate lines Gate3 extend along a row direction, the plurality of output terminals of one third scanning unit 7 is respectively connected to the third gate lines Gate3 in odd-numbered rows, and the plurality of output terminals of the other third scanning unit 7 is respectively connected to the third gate lines Gate3 in even-numbered rows. When the third gate lines Gate3 extend along a column direction, the plurality of output terminals of one third scanning unit 7 is respectively connected to the third gate lines Gate3 in odd-numbered columns, and the plurality of output terminals of the other third scanning unit 7 is respectively connected to the third gate lines Gate3 in even-numbered columns With this arrangement, a time taken for outputting the second data signal to all third gate lines Gate3 can be shorten, thereby reducing a driving time and thus reducing power consumption.

In a practical application, an extending direction of the third data lines Data3 in the main display area is parallel or vertical to an extending direction of the first data lines Data1 in the auxiliary display area. For example, when the third data lines Data3 in the main display area extend along the first direction and the third gate lines Gate3 in the main display area extend along the second direction, referring to FIG. 3 again, the first data lines Data1 in the auxiliary display area extend along the second direction and the first gate lines Gate1 in the auxiliary display area extend along the first direction. In another example, as shown in FIG. 4, it is also possible that the first data lines Data1 in the auxiliary display area extend along the first direction, and the first gate lines Gate1 extend in the second direction.

When a length of the auxiliary display area in the first direction is greater than a length of the auxiliary display area in the second direction, it can be set that the first data lines Data1 in the auxiliary display area extend along the first direction and the first gate lines Gate1 in the auxiliary display area extend in the second direction. When the length of the auxiliary display area in the first direction is smaller than the length of the auxiliary display area in the second direction, it can be set that the first data lines Data1 in the auxiliary display area extend along the second direction and the first gate lines Gate1 in the auxiliary display area extend in the first direction.

Figure 4:
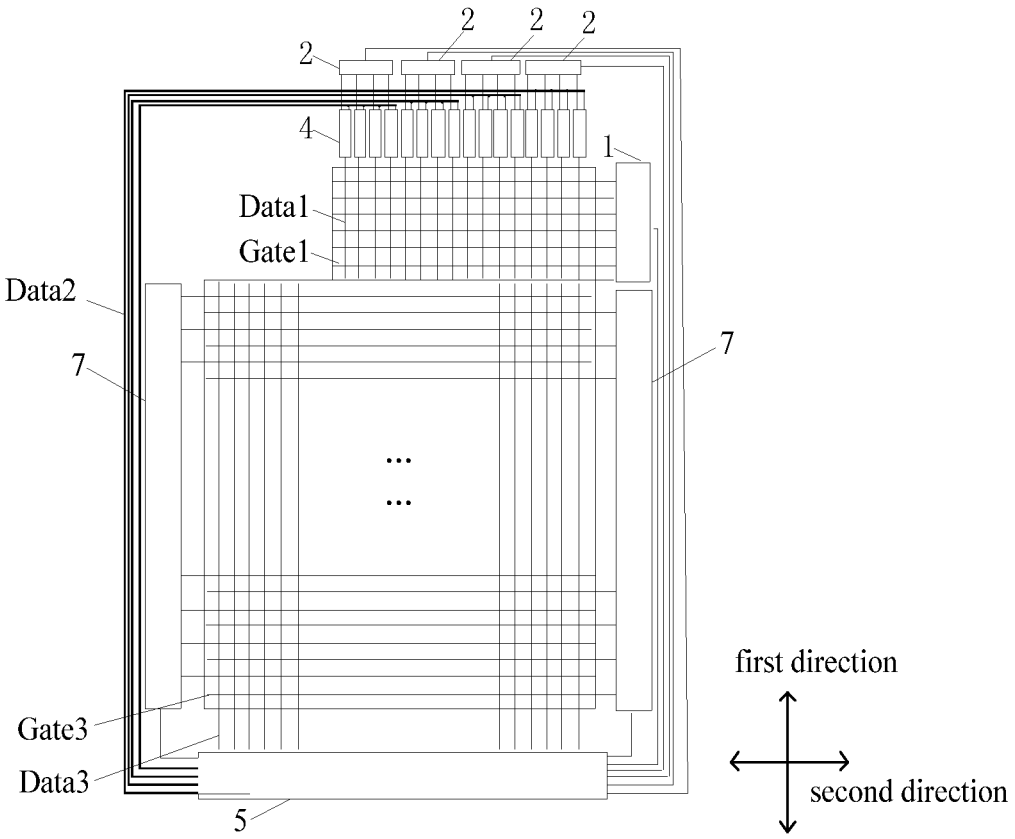
FIG. 4 is another structural schematic diagram of a display panel according to an embodiment of the present disclosure.

For example, where the first direction is the row direction and the second direction is the column direction, when the length of the auxiliary display area in the column direction is smaller than the length of the auxiliary display area in the row direction, a number of the first data lines Data1 arranged in the row direction as shown in FIG. 3 is smaller than a number of the first data lines Data1 arranged in the column direction as shown in FIG. 4. When the second scanning units 2 have a same number of the output terminals, fewer second scanning units 2 and fewer switch unit groups 3 corresponding to the second scanning units 2 are required in the arrangement as shown in FIG. 3, which can further reduce the number of the second data lines Data2, thereby simplifying the wiring arrangement and reducing the space occupied by the second data lines Data2.

It should be understood that, the M second scanning units 2 shown in FIG. 4, where M=4, are merely illustrative, instead of a specific limitation on the number of the second scanning units 2.

When the length of the auxiliary display area in the row direction is smaller than the length of the auxiliary display area in the column direction, it can be set that the first data lines Data1 extend along the column direction and the first gate lines Gate1 extend along the row direction. The principle of arrangement is similar as above, which will not be repeated herein.

Furthermore, the second scanning units 2 can have a same number of outputs, that is, the number of the first data lines Data1 corresponding to a respective second scanning unit 2 is the same, so that a control of the first data lines Data1 can be more regular and easier to implement.

In an embodiment, each second scanning unit 2 can be an N-stage shift register. Correspondingly, the switch unit group 3 corresponding to each second scanning unit 2 includes N switch units 4. The N-stage shift register have N output terminals respectively connected to the control terminals of the N switch units 4 in a corresponding switch unit group 3 in one-to-one correspondence, where N is a positive integer greater than 1.

It is also possible that the first scanning unit 1 and the third scanning unit 7 both have a structure of multi-stage shift register. Taking the first scanning unit 1 as an example, when P' first gate lines Gate1 are provided in the auxiliary display area, the first scanning unit 1 is a P'-stage shift register, and the P'-stage shift register has P' output terminals connected to the P' first gate lines Gate1 in one-to-one correspondence.

In an embodiment, the switch unit 4 can be a thin film transistor. When the switch unit 4 is a thin film transistor, the thin film transistor has a gate connected to the output terminal of a corresponding second scanning unit 2, a source connected to a corresponding first data line Data1, and a drain connected to a corresponding second data line Data2.

When P' first gate lines Gate1 and M*N first data lines Data1 are provided in the auxiliary display area, the first scanning unit 1 is a P-stage shift register, the second scanning unit 2 is an N-stage shift register, the switch unit group 3 is a thin film transistor group, and the switch unit 4 is a thin film transistor, a driving method of the auxiliary display area of the display panel will be described in detail below with reference to FIG. 5 to FIG. 8.

Figure 5:
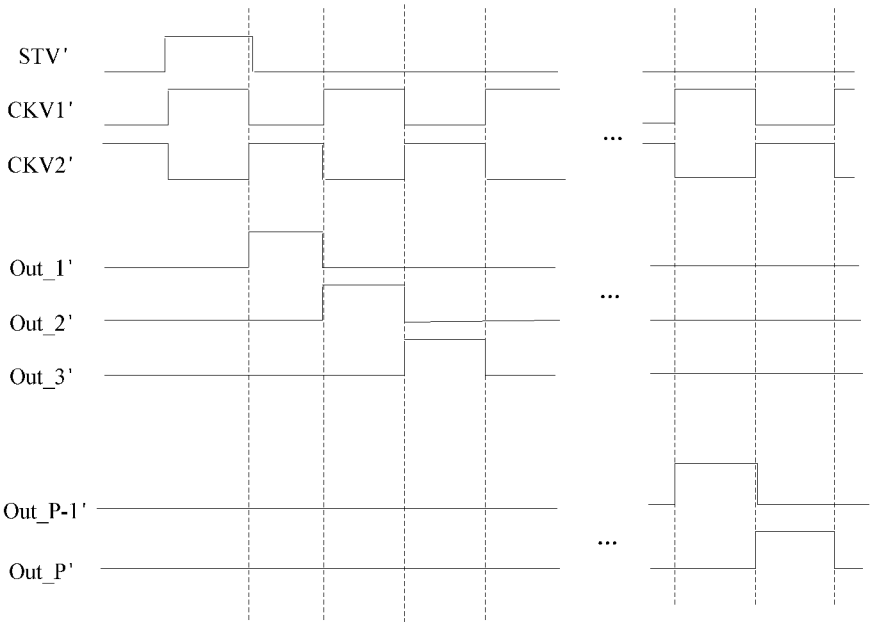
FIG. 5 is a time sequence diagram of corresponding signals when a P-stage shift register drives a first gate line in a time division manner according to an embodiment of the present disclosure.

When the first gate lines Gate1 and the first data lines Data1 in the auxiliary display area are driven to make the auxiliary display area display an image, referring to the signal time sequence diagram shown in FIG. 5, the main driving chip 5 provides a frame start signal STV' to the P'-stage shift register, so as to drive the P'-stage shift register to operate, and the P'-stage shift register provides first scanning signals Out_1'~Out_P' to the P' first gate lines Gate1 under the effect of a first clock signal CKV1' and a second clock signal CKV2' provided by the main driving chip 5.

When each of the first gate lines Gate1 receives the corresponding first scanning signal, the main driving chip 5 also controls the N-stage shift registers 2 having a number of M to operate simultaneously, so that each N-stage shift register 2 controls the corresponding thin film transistors 4 to be turned on in a time division manner. In this way, the first data signal can be transmitted to the corresponding first data lines Data1 via the corresponding second data lines Data2 in a time division manner.

When each first gate line Gate1 receives the first scanning signal, the main driving chip 5 controls the N-stage shift registers 2 having a number of M to operate simultaneously as follows.

Figure 6:
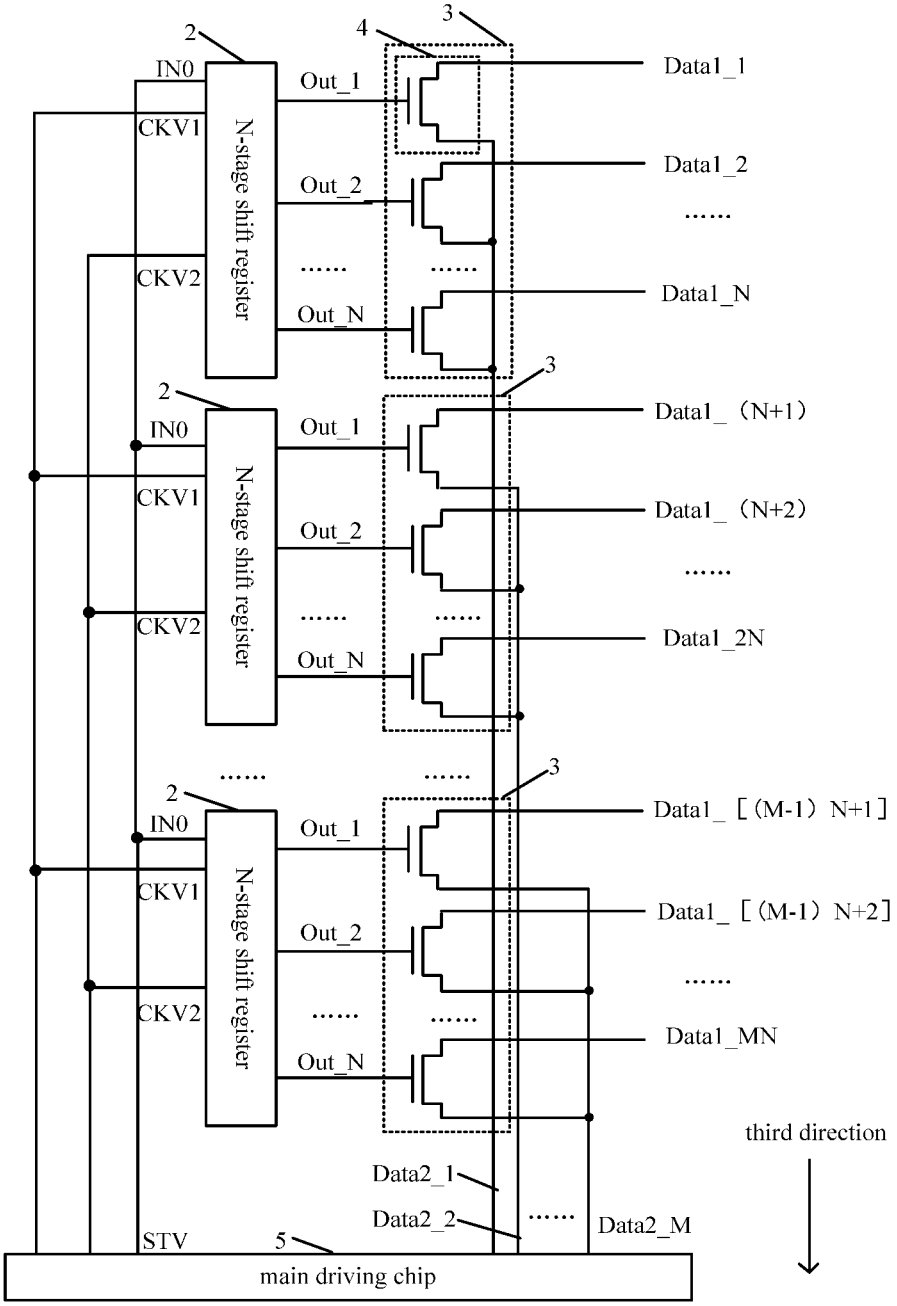
FIG. 6 is a schematic diagram showing a connection between a N-stage shift register and a thin film transistor corresponding to an auxiliary display area of a display panel according to an embodiment of the present disclosure.

As shown in FIG. 6, one N-stage shift register 2 has N output terminals for driving M*N first data lines Data1, so that the N-stage shift registers 2 having a number of M are required in total.

It should be noted that, the second scanning unit 2 is embodied in a form of an N-stage shift register. In order to facilitate understanding, the N-stage shift register 2 is equivalent to the second scanning unit 2. A first N-stage shift register to an $M^{th}$ N-stage shift register are also denoted with the reference numeral 2. Similarly, the thin film transistor group 3 as described below is equivalent to the switch unit group 3. A first thin film transistor group to an $M^{th}$ thin film transistor group are also denoted with the reference numeral 3, and the thin film transistor 4 as described below is equivalent to the switch unit 4.

Further, a number of the N-stage shift registers 2 shown in FIG. 6 is M. The $1^{st}$ N-stage shift register 2 as described below corresponds to the first N-stage shift register 2 in a third direction shown in FIG. 6, a $2^{nd}$ N-stage shift register 2 as described below corresponds to the second N-stage shift register 2 in the third direction shown in FIG. 6, . . . , and the $M^{th}$ N-stage shift register 2 as described below corresponds to the last N-stage shift register 2 in the third direction shown in FIG. 6. The $1^{st}$ thin film transistor group 3 to an $M^{th}$ thin film transistor group 3 shown in FIG. 6 has a same correspondence as the N-stage shift registers 2, which will not be described herein again.

A $1^{st}$ output terminal Out_1 to a $N^{th}$ output terminal Out_N of the $1^{st}$ N-stage shift register 2 are connected to gates of the N thin film transistors 4 of the $1^{st}$ thin film transistor group 3 in one-to-one correspondence, sources of the N thin film transistors 4 of the $1^{st}$ thin film transistor group 3 are connected to a $1^{st}$ first data line Data1_1 to a $N^{th}$ first data line Data1_N in one-to-one correspondence, and drains of the N thin film transistors 4 of the $1^{st}$ thin film transistor group 3 are all connected to a $1^{st}$ second data line Data2_1.

A $1^{st}$ output terminal Out_1 to a $N^{th}$ output terminal Out_N of the $2^{nd}$ N-stage shift register 2 are connected to gates of the N thin film transistors 4 of the $2^{nd}$ thin film transistor group 3 in one-to-one correspondence, sources of the N thin film transistors 4 of the $2^{nd}$ thin film transistor group 3 are connected to a $(N+1)^{th}$ first data line Data1_(N+1) to a $(2N)^{th}$ first data line Data1_2N in one-to-one correspondence, and drains of the N thin film transistors 4 of the 2nd thin film transistor group 3 are all connected to a $2^{nd}$ second data line Data2_2.

Similarly, a $1^{st}$ output terminal Out_1 to a $N^{th}$ output terminal Out_N of the $M^{th}$ N-stage shift register 2 are connected to gates of the N thin film transistors 4 of the $M^{th}$ thin film transistor group 3 in one-to-one correspondence, sources of the N thin film transistors 4 of the $M^{th}$ thin film transistor group 3 are connected to a $[(M-1)N+1)]^{th}$ first data line Data1_[M−1)N+1)]to a $(MN)^{th}$ first data line Data1_MN in one-to-one correspondence, and drains of the N thin film transistors 4 of the $M^{th}$ thin film transistor group 3 are all connected to a $M^{th}$ second data line Data2_M.

In addition, a first clock signal terminal CKV1 and a second clock signal terminal CKV2 of each N-stage shift register 2 are connected to the main driving chip 5, and an initial control terminal IN0 of each N-stage shift register 2 is connected to a frame start signal terminal STV of the main driving chip 5.

When each first gate line Gate1 receives the first scanning signal and needs to drive all first data lines Data1 in the auxiliary display area, the main driving chip 5 provides a frame start signal to the initial control terminal of each N-stage shift register 2 through the frame start signal terminal STV, and thus drives each N-stage shift register 2 to operate simultaneously. Based on the operating principle of the shift register, the $1^{st}$ output terminal Out_1 to the $N^{th}$ output terminal Out_N of each N-stage shift register 2 provide a turn-on signal to the gates of the corresponding thin film transistors 4 in a time division manner, so as to control the corresponding thin film transistors 4 to be turned on in a time division manner. In this way, the first data signal transmitted by the $1^{st}$ second data line Data2_1~the $M^{th}$ second data line Data2_M is transmitted to the corresponding first data lines Data1 via the drains and the sources of the turned-on thin film transistors 4.

Figure 7:
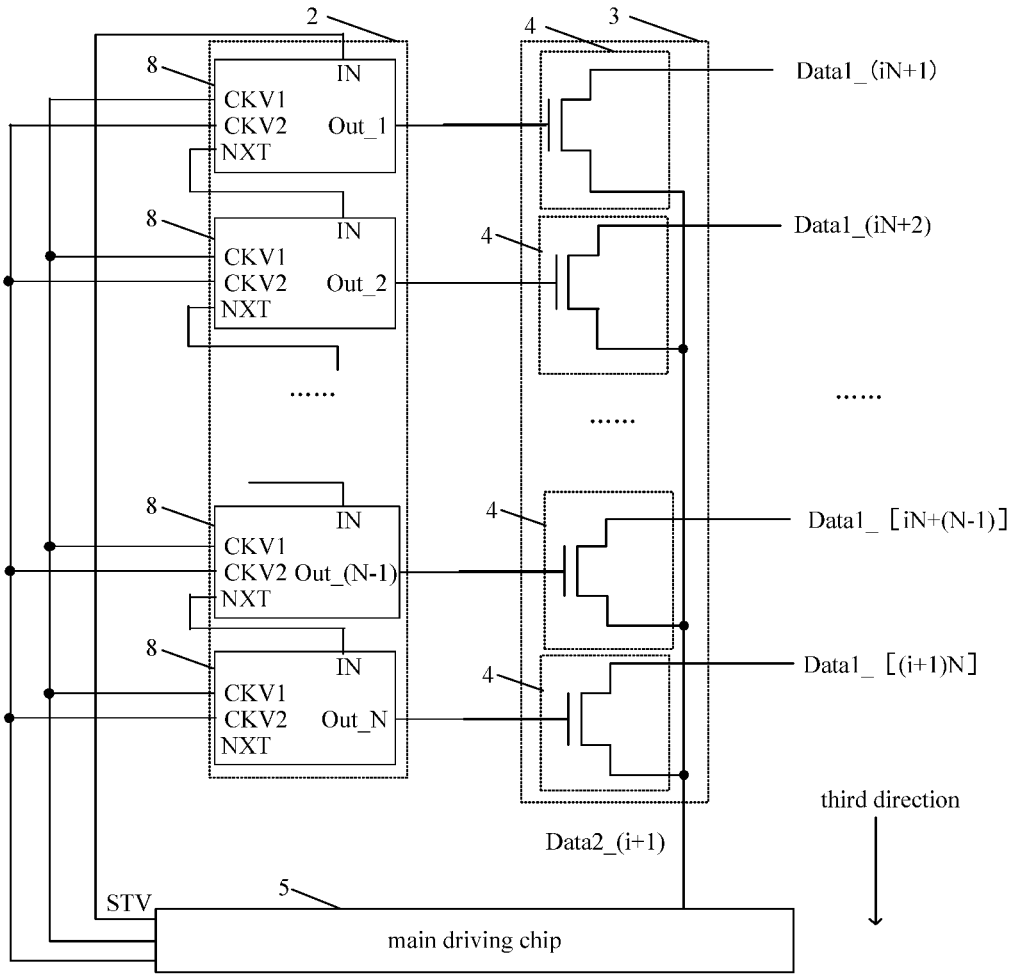
FIG. 7 is a structural schematic diagram of a single N-stage shift register according to an embodiment of the present disclosure.

As shown in FIG. 7, an N-stage shift register 2 can specifically include N cascaded shift registers 8.

It should be noted that a number of the shift registers 8 shown in FIG. 7 is N, and a $1^{st}$ shift register 8 as described below corresponds to the first shift register 8 in the third direction shown in FIG. 7, a $2^{nd}$ shift register 8 as described below corresponds to the second shift register 8 in the third direction as shown in FIG. 7, . . . , and an $N^{th}$ shift register 8 corresponds to the last shift register 8 in the third direction as shown in FIG. 7. The $1^{st}$ thin film transistor 4 to a $N^{th}$ thin film transistor 4 have the same correspondence as the shift registers 8 shown in FIG. 7, which will not be described herein again.

For sake of understanding, the $1^{st}$ shift register to the $N^{th}$ shift register, as described below, are all denoted with the reference numeral 8.

Each shift register 8 includes a first clock signal terminal CKV1, a second clock signal terminal CKV2, and a first control terminal IN (the first control terminal IN of the $1^{st}$ shift register 8 is the initial control terminal IN0 of the above-mentioned N-stage shift register 2), a second control terminal NXT and an output terminal OUT.

The first clock signal terminal CKV1 and the second clock signal terminal CKV2 of each shift register 8 are respectively connected to the main driving chip 5, and the first control terminal IN of the $1^{st}$ shift register 8 is connected to the frame start signal terminal STV of the main driving chip 5. In the two adjacent shift registers 8, the second control terminal NXT of the previous shift register 8 is connected to the first control terminal IN of the latter shift register 8.

The output terminal Out_1 of the $1^{st}$ shift register 8 is connected to the gate of the $1^{st}$ thin film transistor 4 in the thin film transistor group 3, the source of this thin film transistor is connected to a $(iN+1)^{th}$ first data line Data_(iN+1); the output terminal Out_2 of the $2^{nd}$ shift register 8 is connected to the gate of the $2^{nd}$ thin film transistor 4 in the thin film transistor group 3, the source of this thin film transistor is connected to a $(iN+2)^{th}$ first data line Data_(iN+2); . . . ; the output terminal Out_N of the $N^{th}$ shift register 8 is connected to the gate of the $N^{th}$ thin film transistor 4 in the thin film transistor group 3, and the source of this thin film transistor is connected to an $[(i+1)N]^{th}$ first data lines Data1_[(i+1)N]; and the drains of the $1^{st}$ thin film transistor 4 to the $N^{th}$ thin film transistor 4 are all connected to an $(i+1)^{th}$ second data Lines Data2_(i+1), where i=0~M−1.

Figure 8:
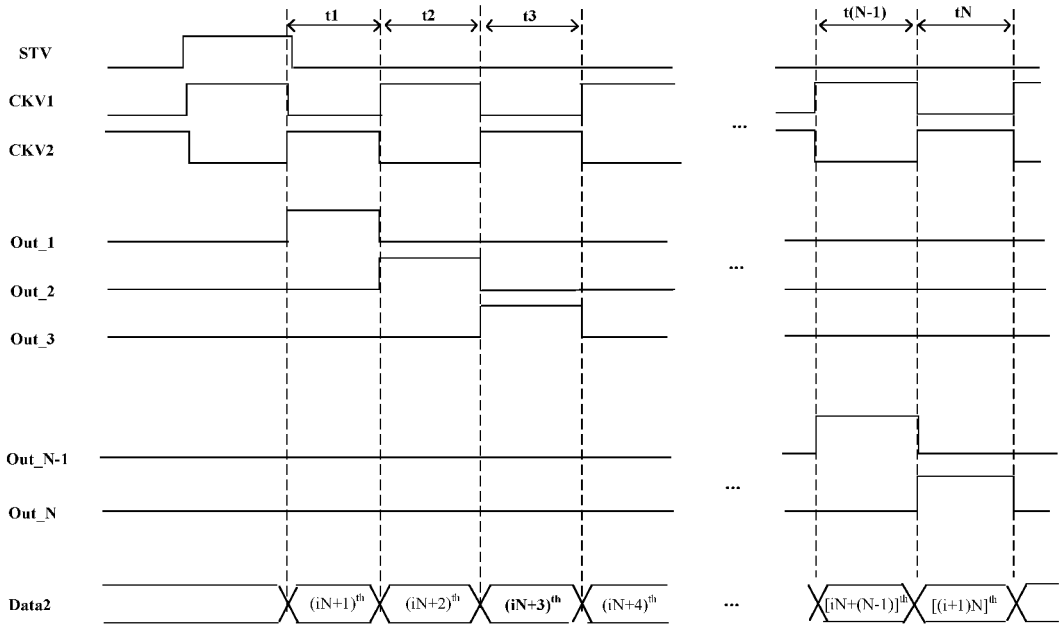
FIG. 8 is a signal time sequence diagram corresponding to a situation in which a single N-stage shift register drives a first data line in a time division manner according to an embodiment of the present disclosure.

FIG. 8 is a signal time sequence diagram of a single N-stage shift register 2. The operating principle of a single N-stage shift register 2 will be described in detail below with reference to FIG. 8. For sake of understanding, in FIG. 8, the frame start signal is represented by STV, the first clock signal is represented by CKV1, the second clock signal is represented by CKV2, and the turn-on signals outputted by the output terminal Out_1 of the $1^{st}$ shift register 8 to the output terminal Out_N of the $N^{th}$ shift register 8 are represented by Out_1~Out_N.

When the auxiliary display area is driven to display an image, the main driving chip 5 provides a frame start signal to the first control terminal IN of the $1^{st}$ shift register 8 via the frame start signal terminal STV, so as to drive the $1^{st}$ shift register 8 to operate. At the same time, the main driving chip 5 provides a first clock signal to the first clock signal terminal CKV1 of each shift register 8. When a first falling edge of the first clock signal occurs, the main driving chip 5 begins providing a second clock signal to the second clock signal terminal CKV2, and the rising edges and falling edges of the first clock signal and the second clock signal occur alternately.

In a time period t1, when an initial rising edge of the second clock signal occurs, the output terminal Out_1 of the $1^{st}$ shift register 8 outputs a turn-on signal to control the $1^{st}$ thin film transistor 4 to be turned on. At this time, a first data signal transmitted by an $(i+1)^{th}$ second data line Data2_(i+1) is transmitted to an $(iN+1)^{th}$ first data line Data_(iN+1) via the $1^{st}$ thin film transistor 4; and meanwhile, the second control terminal NXT of the $1^{st}$ shift register 8 provides a control signal to the first control terminal IN of the $2^{nd}$ shift register 8, so as to control the $2^{nd}$ shift register 8 to operate. In a time period t2, when a second rising edge of the first clock signal occurs, the output terminal Out_2 of the $2^{nd}$ shift register 8 outputs a turn-on signal to control the $2^{nd}$ thin film transistor 4 to be turned on. At this time, a first data signal transmitted by the $(i+1)^{th}$ second data line Data2_(i+1) is transmitted to an $(iN+2)^{th}$ first data line Data_(iN+2) via the $2^{nd}$ thin film transistor 4; and meanwhile, the second control terminal NXT of the $2^{nd}$ shift register 8 provides a control signal to the first control terminal IN of the $3^{rd}$ shift register 8, so as to control the $3^{rd}$ shift register 8 to operate. This procedure is repeated, until a tN time period, in which the $N^{th}$ shift register 8 outputs a turn-on signal to control the $N^{th}$ thin film transistor 4 to be turned on, and a first data signal transmitted by the $(i+1)^{th}$ second data line Data2_(i+1) is transmitted to an $[(i+1)N]^{th}$ first data line Data_[i+1)N] via the $N^{th}$ thin film transistor 4.

The operating process of the entire auxiliary display area will be described below with reference to FIG. 3, FIG. 5 and FIG. 8. FIG. 3 is a schematic diagram of the corresponding structure. FIG. 5 is a time sequence diagram of the first scanning unit 1, where signals Out_1'~Out_P' are transmitted to the corresponding first gate lines Gate1. FIG. 8 is a detailed time sequence diagram of an N-stage shift register 2 in a time period when one of Out_1'~Out_P' of FIG. 5 is at a turn-on level. For example, the display panel provided in this embodiment is a liquid crystal display panel, in which the auxiliary display area includes M*N*P' sub-pixels. The sub-pixels are arranged in M*N rows along a first direction, and arranged in P' columns along a second direction. Each row of sub-pixels corresponds to a first data line Data1, each column of sub-pixels corresponds to a first gate line Gate1, and each sub-pixel corresponds to a switch tube, which has a first terminal connected to the corresponding first data line Data1 and a second terminal connected to the corresponding pixel electrode. The first scanning signals Out_1'~Out_P' are used to control the pixel electrode in which column of sub-pixels should be connected with the corresponding first data line Data1. When the first scanning signal Out_1' is at a turn-on level, the pixel electrode in the $1^{st}$ column of P' columns of sub-pixels is connected to each of the first data lines Data1, during which the N-stage shift registers 2 having a number of M operate simultaneously, the operating process referring to the time sequence shown in FIG. 8 and the above description, so that the first data signal in each second data line Data2 is transmitted to the N first data line Data1 corresponding to each second data line Data2 in a time division manner, thereby charging the pixel electrodes in the $1^{st}$ column of sub-pixels in a time division manner. When the first scanning signal Out_2' is at the turn-on level, the pixel electrode in the $2^{nd}$ column of P' columns of sub-pixels is connected to each of the first data lines Data1, during which the N-stage shift registers 2 having a number of M operate simultaneously, the operating process referring to the time sequence shown in FIG. 8 and the above description, so that the first data signal in each second data line Data2 is transmitted to the N first data line Data1 corresponding to each second data line Data2 in a time division manner, and is further transmitted to the pixel electrodes in the $2^{nd}$ column of sub-pixels in a time division manner. This procedure is repeated, until the signal in the second data line Data2 has been transmitted to the pixel electrode of each sub-pixel through the first data line Data1, that is, charging of the pixel electrodes of all sub-pixels in the entire auxiliary display area is completed, thereby accomplishing the driving of the auxiliary display area.

It should be noted, the time periods t1~tN as shown in FIG. 8 are equivalent to a period during which one of Out_1'~Out_P' shown in FIG. 5 is at the turn-on level. The first data signal in the second data line Data2 varies in the time periods t1~tN depending on a voltage signal required by the sub-pixel corresponding to the $(iN+1)^{th}$ first data line Data1 to the $[(i+1)N]^{th}$ first data line Data1. For example, in the time period t1, the sub-pixel corresponding to the $(iN+1)^{th}$ first data line Data1 requires a voltage of 5 v, and then the first data signal in the second data line Data2 is at 5V; and in the time period t2, the sub-pixel corresponding to the $(iN+2)^{th}$ first data line Data1 requires a voltage of 3 v, and then the first data signal in the second data line Data 2 is at 3V. Since the voltage required by the sub-pixel corresponding to each first data line Data1 needs to be determined by the display image, the first data signal in the second data line Data2 shown in FIG. 8 can only be represented by a random signal.

Although the liquid crystal display panel is taken as an example to describe the present disclosure, the type of the display panel according to the embodiments of the present disclosure is not specifically limited. For example, the organic light-emitting display panel can also be applied to the embodiment of the present disclosure, as long as the signal is transmitted through the first data line Data1 to a gate of a driving transistor corresponding to each sub-pixel, rather than to a pixel electrode corresponding to each sub-pixel, but the driving process is the same.

It should be noted that, in practical applications, the shift register 8 outputs different turn-on signals to the thin film transistor according to the type of the thin film transistor. For example, when the thin film transistor is a PMOS, the shift register 8 outputs a low-level turn-on signal to the corresponding PMOS, and when the thin film transistor is an NMOS, the shift register 8 outputs a high-level turn-on signal to the corresponding NMOS.

In an embodiment, each shift register 8 can include an input strobe module, a latch shift module, and a driving amplification module. The input strobe module is configured to select a scanning direction of the auxiliary display area, the latch shift module is configured to output a turn-on signal and output a shift signal for controlling a next shift register 8 to operate, and the driving amplification module is configured to amplify the turn-on signal outputted by the latch shift module and output a turn-on signal with a strong driving capability to the corresponding thin film transistor. It should be understood that the connection and the operating principle of the input strobe module, the latch shift module and the driving amplification module are known in the prior art, which will not be described herein again.

It can be understood that, when the N-stage shift register is used to drive the data lines or the gate lines extending in the row direction, the N-stage shift register is a horizontal shift register (HSR); and when the stage shift register is used to drive the data lines or the gate line extending in the column direction, the N-stage shift register is a vertical shift register (VSR).

When the auxiliary display area has a resolution of X columns *Y rows, and a frame frequency of the auxiliary display area is f, it is assumed that the number of required second data lines Data2 is M, i.e., N-stage shift registers having a number of M are needed to drive all first data lines Data1 in the auxiliary display area.

When the first data lines Data1 extend along the row direction, based on a calculation formula of a charging time t for a single pixel, $$t = \frac{1/f}{X \times (Y/M)},$$

it can be derived that the number of required second data lines Data2 is $$M = \frac{X \times Y \times t}{1/f}.$$

When the first data lines Data1 extend in the column direction, based on the calculation formula of the charging time t for a single pixel, $$t = \frac{1/f}{Y \times (X/M)},$$

it can be derived that the number is $$M = \frac{X \times Y \times t}{1/f}.$$

It can be seen from $$M = \frac{X \times Y \times t}{1/f},$$

the number M of the second data lines Data2 is proportional to the charging time t for a single pixel. That is, if the pixel is to be charged for a longer time, more second data lines Data2 are needed, which in turn may increase the complexity of wiring of the second data lines Data2. If a smaller number of second data lines Data2 is desired, the charging time for the pixel will be very short, which in turn may lead to an insufficient charging time. Therefore, the number M of the second data lines Data2 should not be too large or too small.

At present, the charging time for a single pixel is preferably 5 μs. Based on this, it is assumed that the auxiliary display area has a size of 160 rows*1040 columns resolution. The number of the second data line Data2 required in such size of the auxiliary display area is deduced as below with aids of two specific embodiments:

Embodiment 1

In this embodiment, the auxiliary display area includes 160 first data lines Data1 extending in the row direction and 1040 first gate lines Gate1 extending in the column direction. If eight 20-stage shift registers are adopted, i.e., corresponding to 8 second data lines Data2, the one-frame charging time for the auxiliary display area is T1=20*1040*5 μs=104 ms, and it can be calculated from f=1/T that the corresponding frame frequency is f1=1/104 ms=10Hz.

If sixteen 10-stage shift registers are used, i.e., corresponding to 16 second data lines Data2, the one-frame charging time for the auxiliary display area is T2=10*1040*5 μs=52 ms, and it can be calculated from f=1/T that the corresponding frame frequency is f2=1/52 ms=20 Hz.

Since the frame frequency f of the current display panel is around 15 Hz, it can be derived from f1<f<f2 that the number of required second data lines Data2 should be greater than 8 and less than 16. For example, in this case, the number of the second data lines Data2 can be 10, so that ten 16-stage shift registers are required.

Embodiment 2

In this embodiment, the auxiliary display area includes 1040 first data lines Data1 extending in the column direction and 160 first gate lines Gate1 extending in the row direction. If eight 130-stage shift registers are adopted, i.e., corresponding to 8 second data lines Data2, the one-frame charging time is T1'=130*160* 5 μs=104 ms, and it can be calculated from f=1/T that the corresponding frame frequency is f1'=1/104 ms=10 Hz.

If sixteen 65-stage shift registers are used, i.e., corresponding to 16 second data lines Data2, the one-frame charging time is T2'=65*160* 5 μs=52 ms, and it can be calculated from f=1/T that the corresponding frame frequency is f2'=1/52 ms=20 Hz.

Since the frame frequency f of the current display panel is around 15 Hz, it can be similarly derived from f1'<f<f2' that the number of required second data lines Data2 should be greater than 8 and less than 16. For example, the number of the second data lines Data2 can be 10 or 13. If the number of the second data lines Data2 is 10, ten 104-stage shift registers are required; and if the number of the second data lines Data2 is 13, thirteen 80-stage shift registers are required Based on the above derivation, while ensuring a sufficient charging time for a single pixel, the number of required second data lines Data2 can be further reduced, thereby reducing the increment of a panel wiring width. For example, in a practical process, if 10 second data lines Data1 are used to drive 1040 first data lines Data1, the increment of the panel wiring width can be reduced to 50 μm.

In addition, since the auxiliary display area is usually used to display some simple icons, instead of presenting the traditional information, the requirement on image quality of the auxiliary display area may be lower than that of the main display area, which will be described in detail in the following two manners.

Manner 1

The resolution of the auxiliary display area is set to be lower than the resolution of the main display area. Specifically, a single sub-pixel in the auxiliary display area can have a larger area than a single sub-pixel in the main display area. That is, a number of sub-pixels per unit area of the auxiliary display area is smaller than a number of sub-pixels per unit area of the main display area.

With this setting, on the premise of ensuring a normal display of the auxiliary display area, on the one hand, the number of the first data lines Data1 in the auxiliary display area is reduced, and thus the number of the second data lines Data2 is correspondingly reduced, thereby simplifying the structure of the second scanning unit 2 and saving layout space; on the other hand, it is also possible to reduce the power consumption required during the driving process by reducing the number of sub-pixels in the auxiliary display area to be driven.

Manner 2

A total number of colors that can be displayed by the auxiliary display area is set to be smaller than a total number of colors that can be displayed by the main display area. That is, the number of colors in the auxiliary display area is smaller than the number of colors in the main display area.

Specifically, the number of colors in the auxiliary display area can be reduced by reducing a number of bits of the auxiliary display area. For example, if the number of bits in the main display area is 8 bits, corresponding to 256 ($2^8$) brightness levels, i.e., 256 gray scales, the number of bits in the auxiliary display area can be reduced to 5 bits, corresponding to 32 ($2^5$) brightness levels, i.e., 32 gray scales. By reducing the brightness levels in the auxiliary display area, several similar colors can be presented with one color, so that the total number of colors to be displayed in the auxiliary display area can be reduced. Moreover, by reducing the total number of colors to be displayed in the auxiliary display area, the computation of the main driving chip 5 can be alleviated, thereby reducing power consumption.

The embodiments of the present disclosure further provide a driving method of a display panel, and the driving method of a display panel is applicable to the display panel as described above.

The driving method of a display panel includes: transmitting, by the first scanning unit under a control of the main driving chip, the first scanning signal to the plurality of first gate lines in a time division manner; controlling, by each second scanning unit, the corresponding switch unit to be turned-on in a time division manner when each of plurality of first gate lines receives the first scanning signal; and transmitting the first data signal to the corresponding first data lines via the second data lines in a time division manner.

It can be understood that the first data signal refers to a signal provided by the main driving chip and used to drive the auxiliary display area to display an image. According to the actual requirement on the image to be displayed by the auxiliary display area, a same or different first data signals can be transmitted via the second data lines.

When using the driving method of a display panel provided by the embodiment, based on the cooperation among the second scanning unit, the switch unit, the first data lines and the second data lines in the display panel, the main driving chip only needs second data lines, the number of which is equal to the number of the second scanning units, to transmit the corresponding first data signal to all first data lines in a time division manner. In this way, the number of second data lines can be reduced to a large extent without additionally setting a sub-driving chip in the display panel, thereby reducing the manufacturing cost of the display panel.

While the auxiliary display area is driven to display an image, the driving method of a display panel provided by the embodiment further includes: transmitting, by the third scanning unit under the control of the main driving chip, a second scanning signal to the plurality of third gate lines in a time division manner; and transmitting, by the main driving chip, the corresponding second data signal to each of the plurality of third gate lines when each of plurality of first gate lines receives the first scanning signal.

It can be understood that the second data signal refers to a signal provided by the main driving chip and used to drive the main display area to display an image. According to the actual requirement on the image to be displayed by the main display area, the main driving chip transmits the corresponding second data signals to different third gate lines.

When the second scanning unit is an N-stage shift register, a specific driving process for the first data lines in the auxiliary display area has been described in detail in the above embodiments, which will not be repeated herein.

Figure 9:
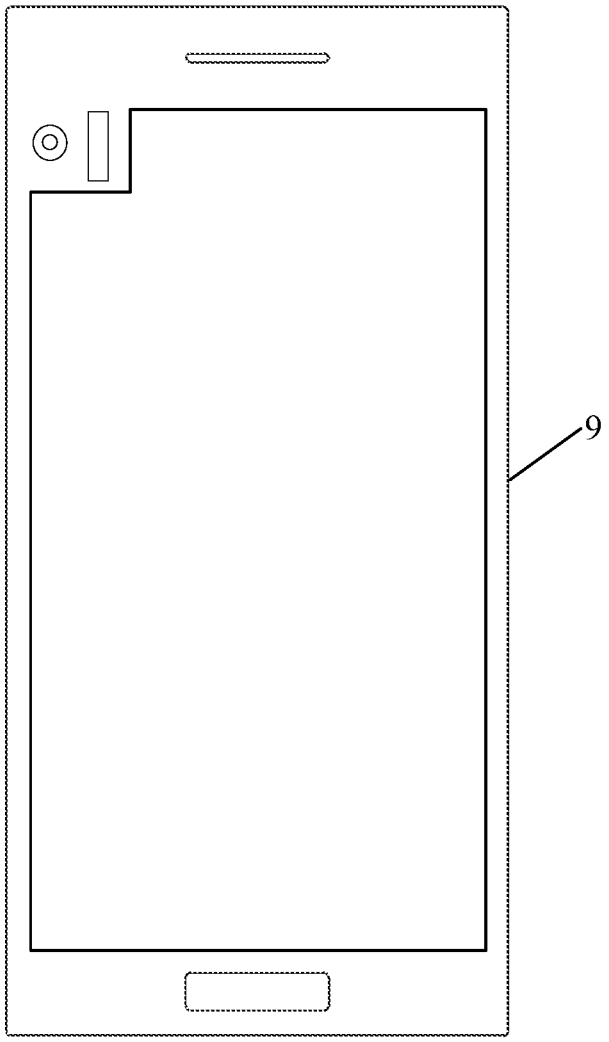
FIG. 9 is a schematic structural diagram of a display device according to an embodiment of the present disclosure.

FIG. 9 is a schematic diagram of a display device 9 according to an embodiment of the present disclosure. The display device 9 includes the display panel described above.

The specific structure and driving principle of the display device are the same as those of the foregoing embodiment, which are not described herein. The display device 9 shown in FIG. 9 is merely illustrative, and the display device can be any electronic device having a display function such as a mobile phone, a tablet computer, a notebook computer, an electronic paper book, or a television.

Since the display device provided by the embodiment includes the display panel as described in the above embodiments, by using the display device provided by the embodiment, on the one hand, the problem of visible boundary in the main display area can be avoided, and on the other hand, the number of second data lines can be reduced to a large extent without additionally setting a sub-driving chip, which can reduce the structural complexity and thus reduces the manufacturing cost.

The above-described embodiments are merely preferable embodiments, but not intended to provide any limitation. Within the spirit and principle of the present disclosure, any modification, equivalent substitution or improvement or replacements should be included with the scope of the present disclosure.

What is claimed is:

1. A display panel, having a main display area and an auxiliary display area protruding from the main display area, wherein the display panel comprises:

a plurality of first data lines and a plurality of first gate lines arranged in the auxiliary display area, wherein the plurality of first data lines intersects with the plurality of first gate lines, and the plurality of first data lines and the plurality of first gate lines are insulated from one another;

a first scanning unit connected to a main driving chip and the plurality of first gate lines;

M second scanning units, each of the M second scanning units having a plurality of output terminals and a control terminal connected to the main driving chip, wherein M is an integer greater than 1;

M switch unit groups corresponding to the M second scanning units in one-to-one correspondence, each of the M switch unit groups comprising a plurality of switch units, wherein the plurality of switch units in each of the M switch unit groups has a plurality of control terminals respectively connected to the plurality of output terminals of a corresponding second scanning unit in one-to-one correspondence, a plurality of first terminals respectively connected to the plurality of first data lines in one-to-one correspondence, and a plurality of second terminals; and M second data lines corresponding to the M switch unit groups in one-to-one correspondence, wherein each of the M second data lines is connected to the main driving chip and the plurality of second terminals of the plurality of switch units in each of the M switch unit groups.

2. The display panel according to claim 1, wherein the display panel further comprises:

a plurality of third data lines and a plurality of third gate lines arranged in the main display area, wherein the plurality of third data lines intersects with the plurality of third gate lines, the plurality of third data lines and the plurality of third gate lines are insulated from one another, and the plurality of third data lines is connected to the main driving chip, respectively; and a third scanning unit connected to the main driving chip and the plurality of third gate lines.

3. The display panel according to claim 2, wherein the plurality of third data lines in the main display area extend along a first direction and the plurality of third gate lines in the main display area extend along a second direction, and wherein the plurality of first data lines in the auxiliary display area extend along the second direction and the plurality of first gate lines in the auxiliary display area extend along the first direction.

4. The display panel according to claim 2, wherein the plurality of third data lines in the main display area extend along a first direction, and the plurality of third gate lines in the main display area extend along a second direction, and wherein the plurality of first data lines in the auxiliary display area extend along the first direction and the plurality of first gate lines in the auxiliary display area extend along the second direction.

5. The display panel according to claim 1, wherein each of the M second scanning units has a same number of the plurality of output terminals.

6. The display panel according to claim 1, wherein one second scanning unit of the M second scanning units is a N-stage shift register, one switch unit group of the M switch unit groups corresponding to the one second scanning unit comprises N switch units, and wherein the N-stage shift register has N output terminals respectively connected to control terminals of the N switch units in the one switch unit group in one-to-one correspondence, where N is an integer greater than 1.

7. The display panel according to claim 1, wherein each of the plurality of switch units is a thin film transistor having a gate connected to one of the plurality of output terminals of a corresponding second scanning unit of the M second scanning units, a source connected to a corresponding first data line of the plurality of first data lines, and a drain connected to a corresponding second data line of the M second data lines.

8. The display panel according to claim 1, wherein a number of the M second data lines is $$M = \frac{X \times Y \times t}{1/f},$$

when the auxiliary display area has a resolution of X columns *Y rows, t is a charging time for a single pixel, and f is a frame frequency of the auxiliary display area.

9. The display panel according to claim 1, wherein a single sub-pixel in the auxiliary display area has an area larger than that of a single sub-pixel in the main display area.

10. The display panel according to claim 1, wherein a number of colors in the auxiliary display area is smaller than a number of colors in the main display area.

11. A driving method of a display panel, applicable to a display panel having a main display area and an auxiliary display area protruding from the main display area, wherein the display panel comprises:

a plurality of first data lines and a plurality of first gate lines arranged in the auxiliary display area, the plurality of first data lines intersects with the plurality of first gate lines, and the plurality of first data lines and the plurality of first gate lines are insulated from one another;

a first scanning unit connected to a main driving chip and the plurality of first gate lines;

M second scanning units, each of the M second scanning units having a plurality of output terminals and a control terminal connected to the main driving chip, wherein M is an integer greater than 1;

M switch unit groups corresponding to the M second scanning units in one-to-one correspondence, each of the M switch unit groups comprising a plurality of switch units, wherein the plurality of switch units in each of the M switch unit groups has a plurality of control terminals respectively connected to the plurality of output terminals of a corresponding second scanning unit in one-to-one correspondence, a plurality of first terminals respectively connected to the plurality of first data lines in one-to-one correspondence, and a plurality of second terminals; and M second data lines corresponding to the M switch unit groups in one-to-one correspondence, wherein each of the M second data lines is connected to the main driving chip and the plurality of second terminals of the plurality of switch units in each of the M switch unit groups, wherein the driving method comprises:

transmitting, by the first scanning unit under a control of the main driving chip, a first scanning signal to the plurality of first gate lines in a time division manner;

controlling, by each of the M second scanning units, the plurality of switch units to be turned-on in a time division manner when each of plurality of first gate lines receives the first scanning signal; and transmitting a first data signal to the plurality of first data lines via the M second data lines in a time division manner.

12. A display device, comprising a display panel having a main display area and an auxiliary display area protruding from the main display area, wherein the display panel comprises:

a plurality of first data lines and a plurality of first gate lines arranged in the auxiliary display area, wherein the plurality of first data lines intersects with the plurality of first gate lines, and the plurality of first data lines and the plurality of first gate lines are insulated from one another;

a first scanning unit connected to a main driving chip and the plurality of first gate lines;

M second scanning units, each of the M second scanning units having a plurality of output terminals and a control terminal connected to the main driving chip, wherein M is an integer greater than 1;

M switch unit groups corresponding to the M second scanning units in one-to-one correspondence, each of the M switch unit groups comprising a plurality of switch units, wherein the plurality of switch units in each of the M switch unit groups has a plurality of control terminals respectively connected to the plurality of output terminals of a corresponding second scanning unit in one-to-one correspondence, a plurality of first terminals respectively connected to the plurality of first data lines in one-to-one correspondence, and a plurality of second terminals; and M second data lines corresponding to the M switch unit groups in one-to-one correspondence, wherein each of the M second data lines is connected to the main driving chip and the plurality of second terminals of the plurality of switch units in each of the M switch unit groups.

* * * * *